US005575446A

United States Patent [19]

Swenson et al.

[11] Patent Number: 5,575,446

[45] Date of Patent: Nov. 19, 1996

[54] CLAMPING DEVICE FOR SECURING CHRISTMAS TREE LIGHT WIRES AND/OR DECORATIONS TO CHRISTMAS TREES

[75] Inventors: Barbara Swenson, P.O. Box 680096, Park City, Utah 84068; D. Scott Beckham, Summit County, Utah

[73] Assignee: Barbara Swenson, Sandy, Utah

[21] Appl. No.: 371,266

[22] Filed: Dec. 23, 1994

[51] Int. Cl.[6] ..... F16B 45/00

[52] U.S. Cl. ..... 248/304; 248/306; 248/340

[58] Field of Search ..... 248/304, 303, 248/306, 340

[56] References Cited

U.S. PATENT DOCUMENTS

| | | | |
|---|---|---|---|
| 3,277,291 | 10/1966 | Holbrook | 240/10 |
| 3,488,025 | 1/1970 | Rowland | 248/304 |
| 3,582,641 | 6/1971 | Choquette | 240/10 |
| 3,870,206 | 3/1975 | Feinberg | 248/340 |
| 3,977,050 | 8/1976 | Perez | 24/150 |
| 4,209,945 | 7/1980 | Dent et al. | 47/84 |
| 4,285,072 | 8/1981 | Morcher et al. | 3/13 |
| 4,775,310 | 10/1988 | Fischer | 425/308 |
| 4,887,785 | 12/1989 | Blaich | 248/304 |
| 4,966,344 | 10/1990 | Gary | 248/317 |
| 4,979,714 | 12/1990 | Russell et al. | 248/303 |
| 5,103,380 | 4/1992 | Lindner et al. | 362/32 |

OTHER PUBLICATIONS

Instructions from package back for Lites Up Gutter Hook made by Gary Products Group, Lubbock, Texas. (no date supplied).

Instructions from package back for Lites Up Ornament Hanger made by Gary Products Group, Lubbock, Texas (no date supplied).

*Primary Examiner*—Ramon O. Ramirez
*Assistant Examiner*—Michael J. Turgeon
*Attorney, Agent, or Firm*—Mallinckrodt & Mallinckrodt

[57] ABSTRACT

A device for clamping the wires of a string of decorative lights to Christmas tree branches is formed of a wholly integral length of flexible, but normally shape-retaining material doubled back on itself from opposite ends thereof at opposite sides of a diagonally oriented, substantially central part of the length of material to provide oppositely directed, open loop clamping portions whose openings are at respective opposite sides of but at the central part of the length of material. The flexible material is such that an opening to an open loop can expand to accept branches to be received and held in a clamping loop along with light string wires and can be rotated to open the opening when release of a branch is desired. A loop of the device is selected for clamping to a branch leaving the other loop to serve as a handle for manipulating the device and thereafter free for receiving a Christmas tree decoration.

15 Claims, 2 Drawing Sheets

CLAMPING DEVICE FOR SECURING CHRISTMAS TREE LIGHT WIRES AND/OR DECORATIONS TO CHRISTMAS TREES

BACKGROUND OF THE INVENTION

1. Field

The invention is in the field of securing Christmas tree lights, garlands, and ornaments to a Christmas tree.

2. State of the Art

Current practice in decorating Christmas trees is generally to drape the wires which connect Christmas tree light sockets with light bulbs therein from branch to branch of the tree to spread the lights around the tree. Generally the wires are not secured to the tree branches. In many instances this means that the wires can slip from the branches, and in some instances, it is difficult to extend the lights in a desired fashion between relatively widely spaced branches. With some light sets, loops in the wire at each light socket are provided with a slide bead over the wires so the loop can be placed about the end of a branch and the slide bead moved to close the loop around the branch to secure the light sockets to desired branches. Other light sockets are provided with clips of some type to enable the light socket to be clipped to a Christmas tree branch. However, the loops and clips generally are provided with relatively large light sockets, and the miniature light sets which have become popular generally do not include any means for securing a light socket to a branch. For some currently available light sets where an upright orientation of the light is important, such as lights which simulate candles, the light socket has a hand-operated spring clip on the bottom of the light socket so the light socket can be clipped to a branch in an upright position.

Similarly to strings of lights, tinsel garlands are generally draped from branch to branch with no means of securing the garland to a branch to hold it from sliding off.

SUMMARY OF THE INVENTION

According to the invention, a device for clamping the wires of a string of decorative lights to Christmas tree branches is formed of a wholly integral length of flexible, but normally shape-retaining material, that is doubled back on itself from opposite ends thereof at opposite sides of a diagonally oriented, substantially central part of the length of material to provide oppositely directed, open loop clamping portions whose openings are at respective opposite sides of but at the central part of the length of material. The clamping loops are generally of different sizes and either of the clamping loops may be selected for clamping a wire of a string of Christmas tree lights to a limb or branch of a Christmas tree. Selection is generally based on the size of the branch to which the device is applied. The other loop provides a handle for manipulating the device and, when in place on a branch, is free for receiving a Christmas tree ornament or other decoration, if desired. Such other loop could, if desired, receive the wire of the decorative light set or could receive a loop of a second device of the invention if additional length is required. The flexible material from which the device is made allows entry of a tree branch into a clamping loop and allows the device to be twisted so that, when desired, a loop thereof can be easily twisted and removed from a branch.

The diagonally oriented, substantially central part of the length of material forms a substantially straight central portion from the ends of which extend the open loop clamping portions. These open loop clamping portions include arcuate portions which extend through at least approximately 270° from the ends of the central portion to double back on the central portion and the arcuate portions flow into relatively short straight portions which extend, preferably substantially parallel to the straight central portion and preferably spaced somewhat from the central portion, to provide openings leading into substantially circular areas formed by the arcuate portions. The relatively short straight portions terminate in end portions which extend at angles outwardly from the central portion to act as guides to the openings between the relatively short portions and the central portion. The transitions between the relatively short straight portion and the end portion are preferably of a relatively large radius compared to the radius of the transitions between the arcuate portions and the relatively short straight portions. This makes it easier to slide the device onto a branch than to slide it off of a branch.

THE DRAWINGS

The best mode presently contemplated for carrying out the invention is illustrated in the accompanying drawings, in which:

FIG. 1 is a side elevation of a device of the invention;

FIG. 2, a perspective view of the device being applied to a Christmas tree branch and decorative light set wire to hold the wire in position on the branch;

FIG. 3, a perspective view similar to that of FIG. 2, showing the device installed on the branch;

FIG. 4, a perspective view similar to that of FIG. 2, but showing the device twisted as it is prepared for removal from the branch; and FIG. 5, a perspective view similar to that of FIG. 2, but show the device as removed from the branch.

DETAILED DESCRIPTION OF THE ILLUSTRATED EMBODIMENTS

Figure 1:
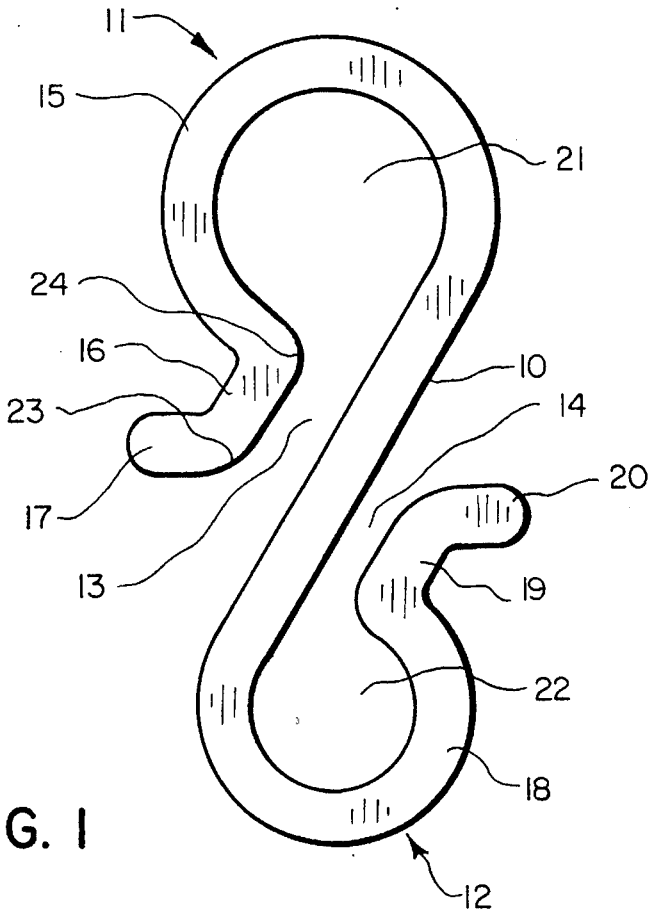

Referring to FIG. 1, the clip or clamping device of the invention is formed of a length of flexible, but normally shape-retaining, material that is doubled back on itself from opposite ends thereof at opposite sides of a diagonally oriented, substantially central part or portion 10 of the length to provide oppositely directed, open loop clamping portions 11 and 12, which open at passage 13 and 14, respectively, at respective opposite sides of central portion 10. Both open loop clamping portions 11 and 12 open along central portion 10.

The central portion 10 is elongate and substantially straight. At each end of the straight central portion 10 is an arcuate portion wherein the clip doubles back on itself to form the open loop elements at each end extending from the central portion 10 in opposite directions. Thus, arcuate portion 15 extends from one end of straight central portion 10, through at least approximately 270° to a relatively short straight portion 16, which preferably is substantially parallel to straight central portion 10, which extends from arcuate portion 15 toward the opposite end of central portion 10. The relatively short straight portion 16 smoothly joins an end portion 17 which extends at an angle outwardly away from the central portion 10. Arcuate portion 18 extends from the opposite end of straight central portion 10, through at least approximately 270° to a relatively short straight portion 19, again which is preferably substantially parallel to straight central portion 10, which extends toward the one end of central portion 10. Relatively short straight portion 19 smoothly joins an end portion 20 which extends at an angle outwardly away from the central portion 10. Arcuate portions 15 and 18 extend from central portion 10 in opposite directions as do end portions 17 and 20. While the relatively short straight portions 16 and 19 could be immediately adjacent central portion 10, it is preferred that they be spaced a short distance from central portion 10 to form the openings or passages 13 between central portion 10 and relatively short straight portion 16, and passage 14 between central portion 10 and relatively short straight portion 19. Passage 13 leads to a substantially circular area 21 formed by arcuate portion 15 and passage 14 leads to substantially circular area 22 formed by arcuate portion 18.

It is important for operation of the device that it be made of a flexible material which is normally shape-retaining which will allow flexing of the open loop portions 11 or 12 to accept and receive branches of a Christmas tree therein. Thus, the arcuate portions 15 or 18 will flex so that the relatively short straight portions 16 or 19 move outwardly whereby the passages 13 or 14 leading to the circular areas 21 or 22 can be enlarged to the normal diameter of the circular areas 21 or 22. This allows passage of a Christmas tree branch into the circular area 21 or 22. The material must also be such that it will return to its original configuration after such flexing so that the arcuate portions 15 or 18 will surround more than one-half of a received branch through the extent of the arc and hold the device on the branch. Polyolefins such as polypropylene and polyethylene have been found to be satisfactory materials. Himont 1050 polypropylene works well.

Each of the open loop portion 11 and 12 will preferably be of different size, i.e., the radius of each of the arcuate portions 15 and 18 will be different, whereby a larger loop can be used for a larger branch and a smaller loop can be used for a smaller branch. However, the loops could be of substantially equal size if desired for particular applications.

As can be seen in FIG. 1, the transition 23 along passage 13 from end portion 17 to relatively short straight portion 16 is smoothly radiused as is the transition 24 from arcuate portion 15 to relatively short straight portion 16. The radius of curvature for transition 23 is relatively large compared to the radius of curvature for transition 24. It is presently preferred that the radius of transition 23 be about double the radius of transition 24. The result of this difference is that it is easier for a branch to cam passage 13 open so the branch can move into circular area 21 than it is for a branch in circular area 21 to cam passage 13 open so that it can move out of circular 21. This is desirable so that it is easy to pull the device over a branch to thereby secure the device to a branch, but so that it is difficult, when once secured, for the branch to come out of the device. This tends to prevent unwanted release of the device from the branch. It is preferred that if a tangent be drawn to the midpoint of the transition, that for transition 23, it intersects the central portion 10 at an angle of between 30° and 45° and that for transition 24 it intersect the central portion 10 at an angle of between 60° and 80°. The transitions for the smaller open loop portion 12 will preferably be substantially the same as for the larger open loop portion 11.

For general indoor Christmas tree use, it is preferred that the clamping device of the invention be as unobtrusive or unnoticeable as possible. It is therefore preferred that the device be sized so that it fits within and does not extend beyond the needles extending from an average fir tree branch. It has been determined that generally an overall device length of about one and one-quarter inch meets this requirement. With such length, the width of the device will be about five-eighths inch. The arcuate portion 15 of the larger open loop portion 11 has a radius of about 0.187 inch and the arcuate portion 18 of the smaller open loop portion 12 has a radius of about 0.125 inch. The radius of the transition 23 from the end portion 17 to the relatively short straight portion 16 is about 0.125 inch while the radius of the transition 24 from the arcuate portion 15 to the relatively short straight portion 16 is about 0.063 inch. The device is made of a length of polypropylene of rectangular cross section with a thickness of about 0.09 inch and a width of about 0.125 inch. Larger passage 13 is about 0.09 inch in width, about the same size as the thickness of the material from which the device is made, and the smaller passage 14 is about two-thirds the size of the larger passage at about 0.06 inch. The lengths of the two relatively short straight portions 16 and 19 are equal and are about 0.09 inches, equal to the width of the larger passage 13. End portions 17 and 20 extend outwardly at an angle of about 60° from the central portion 10.

The above measurements are currently preferred for indoor Christmas tree use, however, it should be realized that the device of the invention could be made in various sizes and, particularly, could be made in a larger size for use with large outdoor trees whose branches are generally larger than indoor Christmas trees.

Figure 2:
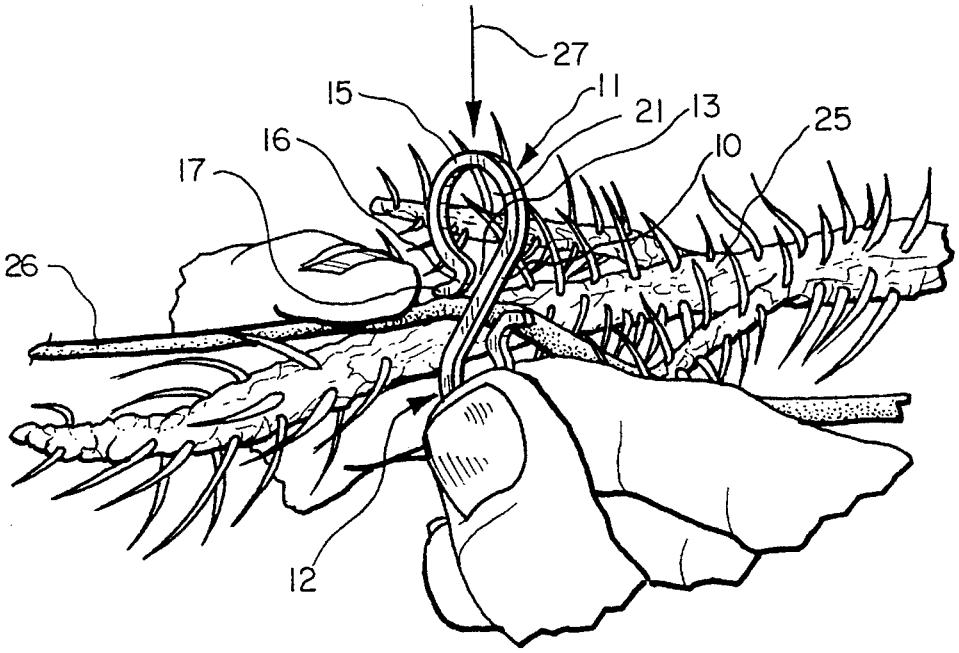
Figure 3:
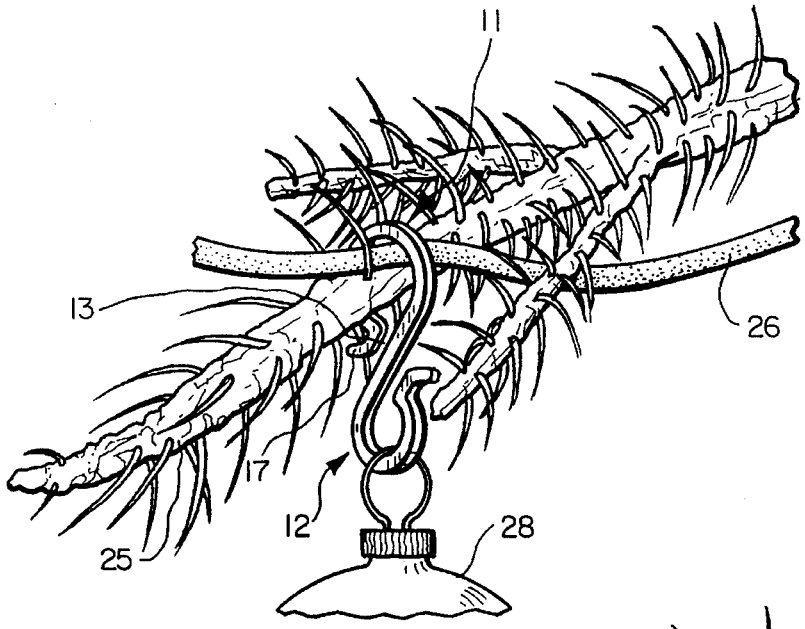

In use, a user selects the particular open loop portion 11 or 12 to be used with and receive a particular branch, such as loop 11 in FIGS. 2–5, and holds the other open loop portion, 12 in FIGS. 2–5, as a handle to manipulate the device. The entrance to open loop portion 11, formed by end portion 17 leading to passage 13 is positioned adjacent a selected branch 25. If the device is being used to secure a wire 26 of a decorative light set in one of the securement arrangements of the invention, the wire 26 is placed over the branch as shown in FIG. 2 and the entrance to open loop portion 11 is positioned at the intersection of the branch and wire. The device is pulled against the branch in the direction of arrow 27. The loop will flex to enlarge passage 13 so that branch 25 will pass through passage 13 as the device is moved in the direction of the arrow 27 and pass into circular area 21. Open loop portion 11 will close around branch 25 to secure the device to the branch as shown in FIG. 3. Wire 26 is then held in place on branch 25 as shown in FIG. 3. With the current arrangement of the end portion 17 and transition 23 therefrom to relatively short straight portion 16, the device slips easily onto branch 25. With the described arrangement of the transition 24 from the arcuate portion 15 to relative short straight portion 16, it is difficult to slide the device from branch 25. A branch 25 does not have to completely fill circular area 21 for the device to be secured thereto. The branch 25 merely need be larger than passage 13 so that it does not easily pass back through the passage to release the device. Thus, the device will clamp a wire to the branch and hold it in position and will stay on the branch even when loose about the branch.

With the device of the invention secured to branch 25 as shown in FIG. 3, open loop portion 12 is available to receive and hang an ornament 28. Alternately, light string wire 26, rather than being held in place over branch 25 by open loop portion 11 around branch 25, could be positioned in and held in place by open loop portion 12. Tinsel and other garlands could be secured and held to branch 25 in the same manner as wire 26. Further, if a light wire, garland, ornament, or other item is to be supported in position at a greater distance below branch 25, one or more additional devices could be used, one hung from the other end-to-end, to support such item at any desired distance from the branch.

Figure 4:
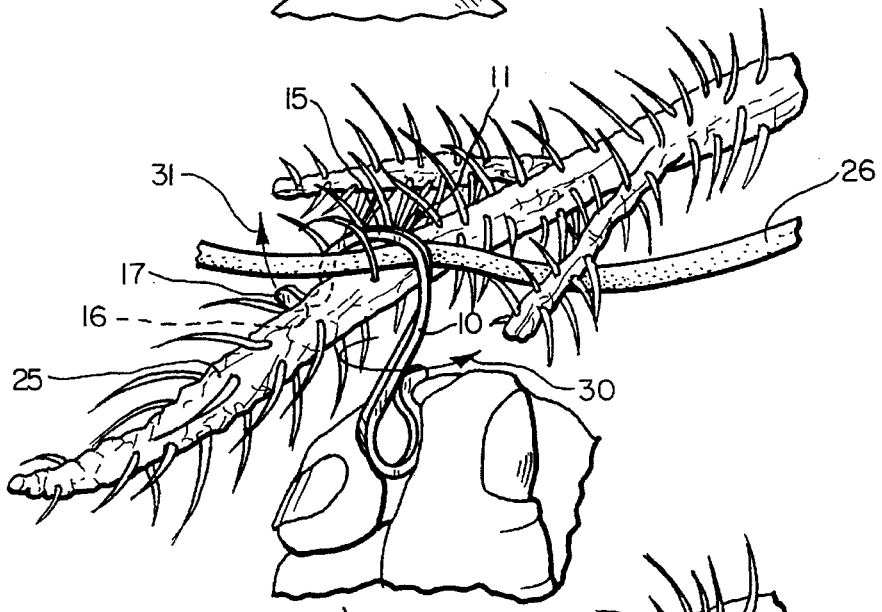
Figure 5:
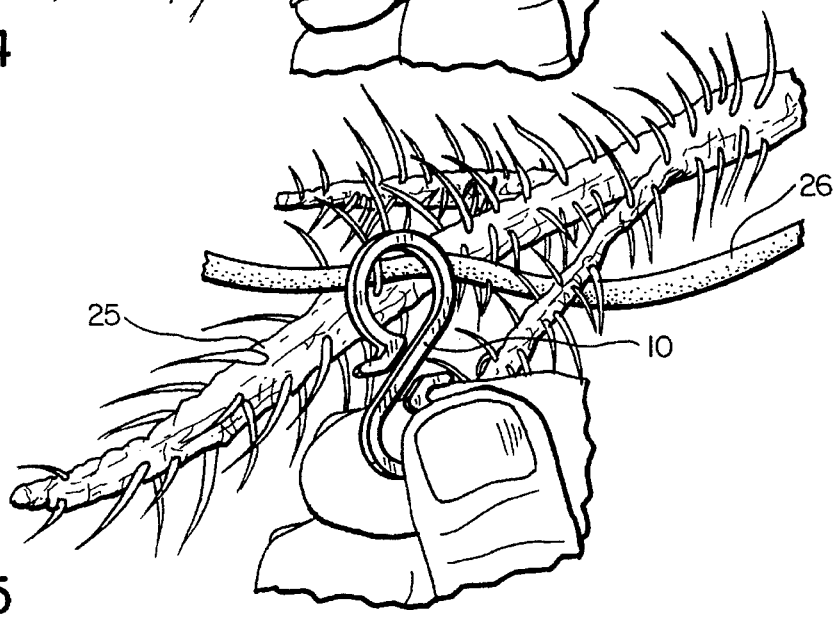

When it is desired to remove the device from the branch 25, a user could, using the entrance to passage 13 formed by end portion 17, flex open loop portion 11 to open passage 13 to allow the device to be removed from branch 25. A preferred method of removal, because it is generally easier, is to grasp the device and twist it as shown by arrow 30 in FIG. 4 to flex open loop portion 11 and straight central portion 10 so that the end of the loop formed by relatively short straight portion 16 and end portion 17 are rotated approximately 90° from their original positions to thereby open passage 13 as shown in FIG. 4, and while in that position, the device is moved upwardly in the direction of arrow 31 and removed from the branch 25. After removal, the material returns to its original configuration and the removed device is shown in FIG. 5.

While it is preferred that relatively short straight portions 16 and 19 extend parallel to central portion 10, this is not necessary and in some instances, particularly with the smaller loop, warpage during cooling of the device after molding may result in portion 19 extending at an angle to central relatively short straight portion 10.

While it is preferred that the branch on which the device is secured fits within the space normally formed by the arcuate portion, with the materials used and the configuration of the device as shown, even if the branch is somewhat bigger than the opening normally formed by the arcuate portion, the device will flex and effectively clamp and hold the branch.

Whereas this invention is here illustrated and described with reference an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A device for clamping the wires of a string of Christmas tree lights to Christmas tree branches and at the same time providing for attachment of a tree decoration, comprising a wholly integral length of flexible but normally shape-retaining material that is doubled back on itself from opposite ends thereof at opposite sides of a diagonally oriented, substantially central part of said length to provide oppositely directed, open loop clamping portions whose openings are at respective opposite sides of but at said central part of said length, said openings formed by relatively short straight portions substantially parallel to the central part of said length, whereby either of said clamping loops may be selected for clamping of a wire of a string of Christmas tree lights to a branch of the Christmas tree, leaving the other free for receiving a Christmas tree decoration.

2. A device according to claim 1, wherein the flexible, normally shape-retaining material is a polyolefin.

3. A device according to claim 2, wherein the polyolefin is polypropylene.

4. A device according to claim 1, wherein the clamping loops are of different sizes so that selection of the clamping loop is based upon the size of the branch to which the wire is to be clamped.

5. A device for securing the wire of a decorative light string or an ornament to a Christmas tree comprising:

an elongate, substantially straight central portion having opposite ends;

a first arcuate portion extending in a direction from one end of the central portion through an arc of at least approximately 270° to a first arcuate portion end;

a first relatively short straight portion extending from the first arcuate portion end toward the opposite end of the substantially straight central portion, said first relatively short straight portion being substantially parallel with said substantially straight central portion and having a first relatively short portion end toward said opposite end;

a first end portion extending from the first relatively short portion end at an angle outwardly away from the central portion;

a second arcuate portion extending from the opposite end of the central portion in a direction opposite to the direction of the first arcuate portion through an arc of at least approximately 270° to a second arcuate portion end;

a second relatively short straight portion extending from the second arcuate portion end toward the one end of the substantially straight central portion, said second relatively short straight portion being substantially parallel with said substantially straight central portion and having a second relatively short portion end toward said one end; and a second end portion extending from the second relatively short portion end at an angle outwardly away from the central portion;

all portions of said device being unitarily formed of a flexible, normally shape-retaining material to allow said first arcuate portion to bend to allow a tree branch to pass between the central portion and first relatively short straight portion to be received within a space within the first arcuate portion and to allow said first arcuate portion to be twisted sufficiently when desired to allow escape of a received tree branch from the space within the first arcuate portion.

6. A device according to claim 5, wherein the first and second relatively short straight portions are spaced from the central portion to provide an opening therebetween.

7. A device according to claim 5, wherein the flexible material allows the second arcuate portion to bend to allow a tree branch to pass between the central portion and the second relatively short straight portion to be received within a space within the second arcuate portion and to allow the second arcuate portion to be twisted sufficiently when desired to allow escape of a received tree branch from the space within the second arcuate portion.

8. A device according to claim 5, wherein each arcuate portion extends at a constant radius along its length.

9. A device according to claim 8, wherein the first arcuate portion has a first radius and the second arcuate portion has a second radius, and wherein the first and second radii are different, whereby the space within one arcuate portion is larger than the space within the other arcuate portion so that larger branches may be received within the larger space.

10. A device according to claim 5, including a smooth arcuate transition of substantially constant radius from the first end portion to the first relatively short portion and a smooth arcuate transition of substantially constant radius from the first arcuate portion to the first relatively short portion, wherein the radius of the transition from the first end portion to the first relatively short portion is larger than the radius of the transition from the first arcuate portion to the first relatively short portion, whereby it is easier to slide the device onto a branch than it is to slide the device off of a branch.

11. A device according to claim 10, wherein the larger radius is about twice the smaller radius.

12. A device according to claim 10, including a smooth arcuate transition of substantially constant radius from the second end portion to the second relatively short portion and a smooth arcuate transition of substantially constant radius from the second arcuate portion to the second relatively short portion, wherein the radius of the transition from the second end portion to the second relatively short portion is larger than the radius of the transition from the second arcuate portion to the second relatively short portion, whereby it is easier to slide the device onto a branch than it is to slide the device off of a branch.

13. A device according to claim 12, wherein the larger radius is about twice the smaller radius.

14. A device according to claim 5, wherein the flexible, normally shape-retaining material is a polyolefin.

15. device according to claim 14, wherein the polyolefin is polypropylene.

* * * * *